US006779356B2

(12) United States Patent
Lee et al.

(10) Patent No.: US 6,779,356 B2
(45) Date of Patent: Aug. 24, 2004

(54) APPARATUS AND METHOD FOR CONTROLLING OPERATION OF AIR CONDITIONER

(75) Inventors: Won Hee Lee, Seoul (KR); Cheol Min Kim, Kyunggi-do (KR); Yoon Jei Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/638,482

(22) Filed: Aug. 12, 2003

(65) Prior Publication Data

US 2004/0134206 A1 Jul. 15, 2004

(30) Foreign Application Priority Data

Jan. 13, 2003 (KR) ..... 10-2003-2101

(51) Int. Cl.[7] ..... F25B 49/02

(52) U.S. Cl. ..... 62/204; 62/210; 62/228.5

(58) Field of Search ..... 62/204, 208, 209, 62/210, 211, 212, 203, 222, 223, 224, 225, 228.1, 228.3, 228.4, 228.5

(56) References Cited

U.S. PATENT DOCUMENTS 5,035,119 A * 7/1991 Alsenz ..... 62/225
6,408,635 B1 * 6/2002 Pham et al. ..... 62/222
6,505,476 B1 * 1/2003 Nishida et al. ..... 62/228.5
6,519,958 B1 * 2/2003 Moon et al. ..... 62/199

* cited by examiner

*Primary Examiner*—Harry B. Tanner
(74) *Attorney, Agent, or Firm*—Greenblum & Bernstein, P.L.C.

(57) ABSTRACT

Disclosed are an apparatus and a method for controlling the operation of an air conditioner, in which one or more compressors are operated so that the total refrigerant compression capacity of the operating compressors is variably changed according to a cooling or heating load to be eliminated, and an opening degree of an electronic expansion valve is controlled between minimum and maximum values set according to the total refrigerant compression capacity of the operating compressors, thus stably operating the air conditioner and preventing the refrigerant in a liquid state from being introduced into the compressors and the compressors from overheating.

18 Claims, 5 Drawing Sheets

APPARATUS AND METHOD FOR CONTROLLING OPERATION OF AIR CONDITIONER

BACKGROUND OF THE INVENTION

1. Field of the Invention

The present invention relates to an apparatus and a method for controlling the operation of an air conditioner for cooling or heating indoor air.

2. Description of the Related Art

Generally, an air conditioner is an appliance for cooling or heating an indoor space, such as a residential space, a restaurant, an office room, or etc. The air conditioner comprises a compressor, a condenser, an expansion device, and an evaporator. The compressor serves to compress a refrigerant into a high-temperature and high-pressure gaseous state. The condenser serves to condense the refrigerant passing through the compressor into a high-temperature and high-pressure liquid state. The expansion device serves to decompress the refrigerant passing through the condenser into a low-temperature and low-pressure liquid state. The evaporator serves to evaporate the refrigerant passing through the expansion device into a low-temperature and low-pressure gaseous state. The compressor, the condenser, the expansion device, and the evaporator are connected through a refrigerant pipe.

A heat pump-type air conditioner further comprises a direction change valve, such as a 3-way valve or a 4-way valve, adapted to change the flow direction of the refrigerant based on a cooling/heating function, thereby being selectively operated in a cooling or heating mode.

In the cooling mode of the air conditioner, an outdoor heat exchanger functions as the condenser, and an indoor heat exchanger functions as the evaporator. On the other hand, in the heating mode of the air conditioner, the outdoor heat exchanger functions as the evaporator, and the indoor heat exchanger functions as the condenser.

In the cooling mode, the air conditioner allows indoor air to pass through the indoor heat exchanger functioning as the evaporator, thereby discharging cold air to the room. In the heating mode, the air conditioner allows indoor air to pass through the indoor heat exchanger functioning as the condenser, thereby discharging warm air to the room.

A recently developed air conditioner employs a plurality of compressors having different capacities so that the plural compressors are simultaneously or selectively operated in accordance with a cooling or heating load. Accordingly, it is possible to properly cope with the variation of the cooling or heating load, thereby optimizing the cooling or heating efficiency of the air conditioner.

Generally, a capillary tube or an electronic expansion valve may be used as the expansion device. The electronic expansion valve is mainly used as the expansion device for adjusting the flow rate of the refrigerant so that the cooling or heating capacity of the air conditioner can be variably changed.

A user selects one of the cooling and heating modes of the air conditioner, and sets a desirable target temperature. Then, a cooling or heating load to be eliminated is determined by the difference between the target temperature and a current room temperature. Under the condition in which the flow rate of the refrigerant is controlled according to the determined cooling or heating load, the refrigerant passes through the compressors, the condenser, the electronic expansion valve and the evaporator sequentially. Thereby, the air conditioner is operated in the cooling or heating mode.

The conventional air conditioner has recently become large in size, thus requiring a plurality of compressors. One or more compressors of the above plural compressors are selectively operated according to a cooling or heating load to be eliminated. The total refrigerant compression capacity of the operating compressors is variably changed according to the variation of the cooling or heating load, but the flow rate of the refrigerant set according to an initial cooling or heating load is fixed.

Accordingly, in case that the circulating rate of the refrigerant is smaller than the total refrigerant compression capacity of the operating compressors, i.e., the rate of the refrigerant compressed by the operating compressors, the operating compressors are overheated. On the other hand, in case that the circulating rate of the refrigerant is larger than the rate of the refrigerant compressed by the operating compressors, the refrigerant is introduced into the compressors, thus causing failure of the compressors. Further, these cases cause an air conditioning system using the air conditioner to be in an abnormal state, thereby lowering the efficiency of the air conditioning system.

SUMMARY OF THE INVENTION

Therefore, the present invention has been made in view of the above problems, and it is an object of the present invention to provide an apparatus for controlling the operation of an air conditioner, in which one or more compressors are operated according to a cooling or heating load to be eliminated and the flow rate of a refrigerant is controlled, so that an air conditioning system using the apparatus is stably operated.

It is another object of the present invention to provide a method for controlling the operation of an air conditioner in which one or more compressors are operated according to the variation of a cooling or heating load and the flow rate of a refrigerant is controlled within a set range based on the total refrigerant compression capacity of the operating compressors, thus rapidly coping with the variation of the cooling or heating load and improving a cooling or heating efficiency.

In accordance with one aspect of the present invention, the above and other objects can be accomplished by the provision of an apparatus for controlling an operation of an air conditioner having a plurality of compressors simultaneously or selectively operated according to a cooling/heating load for compressing a refrigerant so that the total refrigerant compression capacity of the operating compressors are variably changed, a condenser for condensing the refrigerant compressed by the compressors by heat-exchanging the refrigerant with air, an electronic expansion valve for expanding the refrigerant condensed by the condenser by decompressing the refrigerant, an evaporator for evaporating the refrigerant expanded by the electronic expansion valve by heat-exchanging the refrigerant with air, and a refrigerant pipe for connecting the compressors, the condenser, the electronic expansion valve, and the evaporator, comprising: a first temperature sensor, installed at the refrigerant pipe connected to the condenser, for measuring the temperature of the refrigerant; a second temperature sensor, installed at the refrigerant pipe connected to the evaporator, for measuring the temperature of the refrigerant; a third temperature sensor, installed at the refrigerant pipe connected to the compressors, for measuring the temperature of the refrigerant sucked into or discharged from the compressors; and a control unit for calculating the cooling/heating load according to the temperatures of the refrigerant measured by the first, second and third temperature sensors and a desirable target temperature set by a user, controlling the operation of the plural compressors according to the cooling/heating load, calculating minimum and maximum values of an opening degree of the electronic expansion valve according to the total refrigerant compression capacity of operating compressors selected from the plural compressors, and controlling the opening degree of the electronic expansion valve between the minimum and maximum values.

Preferably, the plural compressors may include first and second compressors having different refrigerant compression capacities, and the refrigerant compression capacity of the first compressor may be larger than that of the second compressor.

Further, preferably, the control unit may operate both of the first and second compressors simultaneously or operates only the second compressor, according to the cooling load, in a cooling mode, or operate both of the first and second compressors simultaneously or operates only the first compressor, according to the heating load, in a heating mode.

Preferably, the apparatus may further comprise an outdoor temperature sensor installed at one side of an outdoor heat exchanger functioning as the condenser or the evaporator.

Further, preferably, the control unit may calculate the minimum and maximum values of the electronic expansion valve in consideration of the outdoor temperature measured by the outdoor temperature sensor.

In accordance with another aspect of the present invention, there is provided a method for controlling an operation of an air conditioner comprising the steps of: (a) operating one or more of a plurality of compressors so that the total refrigerant compression capacity of the operating compressors is variably changed according to a cooling/heating load; (b) setting minimum and maximum values of an opening degree of an electronic expansion valve according to the total refrigerant compression capacity of the operating compressors in a cooling or heating mode; and (c) controlling an opening degree of the electronic expansion valve between the set minimum and maximum values.

Preferably, the step (a) may include the step of determining whether first and second compressors having different refrigerant compression capacities are simultaneously or selectively operated.

More preferably, the refrigerant compression capacity of the first compressor is larger than that of the second compressor.

Preferably, the first and second compressors may be simultaneously operated or only the second compressor is operated, according to the cooling load, at the step (a) in a cooling mode, or the first and second compressors may be simultaneously operated or only the first compressor is operated, according to the heating load, at the step (a) in a heating mode.

More preferably, the step (b) may include the step of variably setting the minimum and maximum values of the electronic expansion valve in accordance with the outdoor temperature, in case that both of the first and the second compressors are simultaneously operated in the cooling mode.

Preferably, the minimum and maximum values may be set so that a passage through the electronic expansion valve is opened in the range of 46~64% at the step (b), when the outdoor temperature is more than a set value, in case that both of the first and the second compressors are simultaneously operated in the cooling mode. The minimum and maximum values may be set so that a passage through the electronic expansion valve is opened in the range of 32~64% at the step (b), when the outdoor temperature is not more than a set value, in case that both of the first and the second compressors are simultaneously operated in the cooling mode.

And, preferably, the minimum and maximum values may be set so that a passage through the electronic expansion valve is opened in the range of 18~38% at the step (b), in case that only the second compressor is operated in the cooling mode.

Further, preferably, the minimum and maximum values may be set so that a passage through the electronic expansion valve is opened in the range of 16~50% at the step (b), in case that both of the first and the second compressors are simultaneously operated in the heating mode.

Moreover, preferably, the minimum and maximum values may be set so that a passage through the electronic expansion valve is opened in the range of 12~44% at the step (b), in case that only the first compressor is operated in the heating mode.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
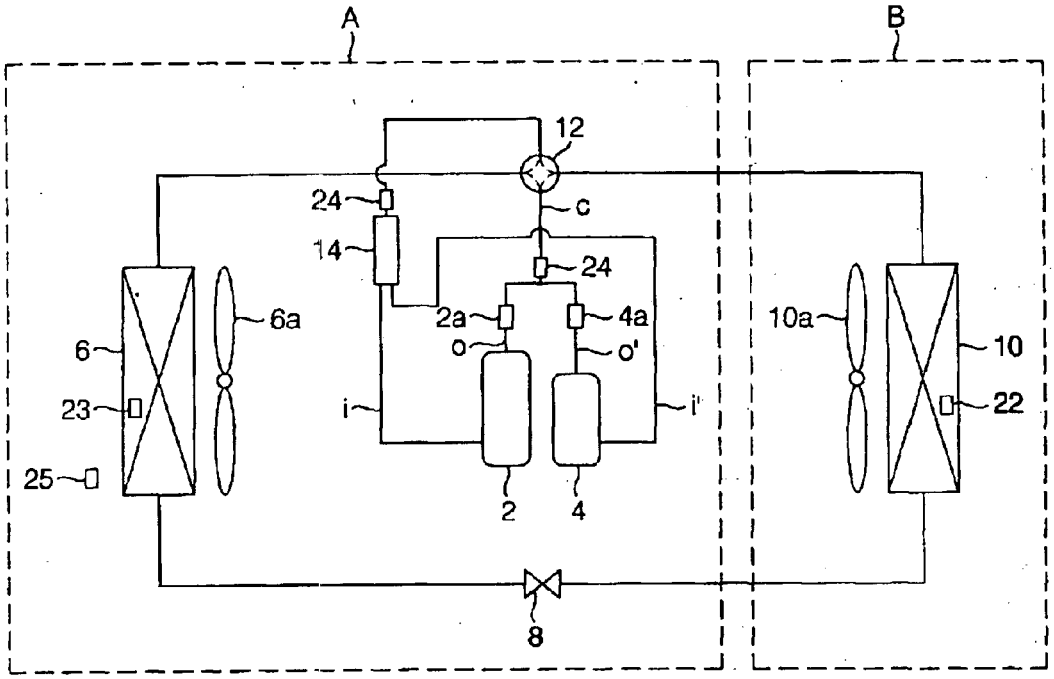
FIG. 1 is a schematic view of an air conditioner in accordance with the present invention.
Figure 2:
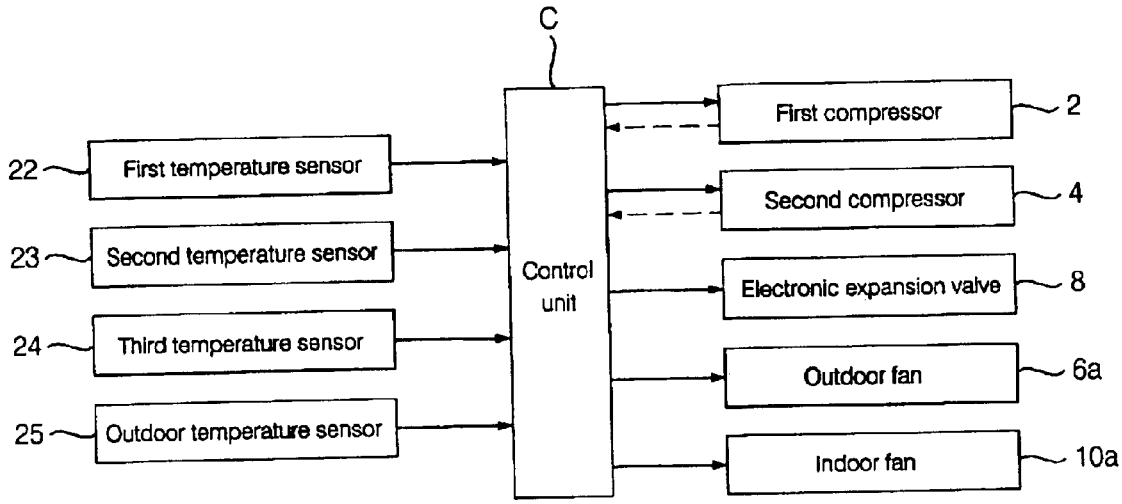
FIG. 2 is a block diagram of an apparatus for controlling the operation of the air conditioner in accordance with the present invention.

As shown in FIGS. 1 and 2, an air conditioner in accordance with the present invention comprises an outdoor unit (A) installed outdoors for compressing, condensing and expanding a refrigerant in a cooling mode, an indoor unit (B) installed indoors so as to be connected to the outdoor unit (A) via a refrigerant pipe for evaporating the refrigerant in the cooling mode, and a control unit (C) for controlling operations of compressors and an electronic expansion valve of the outdoor unit (A).

Here, the outdoor unit (A) includes first and second compressors 2 and 4, an outdoor heat exchanger 6, an outdoor fan 6*a*, an electronic expansion valve 8, an oil separation unit 14, and a refrigerant pipe, for connecting such components, provided with a plurality of check valves 2*a* and 4*a* installed therein. The indoor unit (B) includes an indoor heat exchanger 10 and an indoor fan 10*a*.

More specifically, outlet lines o and o' are connected to one of the ends of the first and second compressors 2 and 4, respectively. In order to prevent the backflow of the refrigerant into the first and second compressors 2 and 4, the first and second check valves 2*a* and 4*a* are installed in the outlet lines o and o'. A connection pipe c is connected to the outlet lines o and o' so that the refrigerants discharged via the two outlet lines o and o' are joined together therein and then guided to a condenser, an expansion device and an evaporator during an air conditioning cycle.

Inlet lines i and i' are branched from the end of the connection pipe c, and connected to the first and second compressors 2 and 4 so as to guide the refrigerant to the first and second compressors 2 and 4. The oil separation unit 14 is positioned between the connection pipe c and the inlet lines i and i', and serves to separate oil discharged together with the refrigerant from the first and second compressors 2 and 4 and to supply the separated oil to each of the first and second compressors 52 and 54, and to prevent the refrigerant from being introduced into the first and second compressors 2 and 4.

Here, a direction change valve 12 for selectively controlling the flow direction of the refrigerant is installed in the connection pipe c connected to the ends of the first and second check valves 2*a* and 4*a*. The direction change valve 12 allows the refrigerant compressed by the first and second compressors 2 and 4 to flow toward the outdoor heat exchanger 6, thereby forming a cooling cycle, or to flow toward the indoor heat exchanger 10, thereby forming a heating cycle.

The refrigerant compression capacity of the first compressor 2 is different from the refrigerant compression capacity of the second compressor 4. That is, the refrigerant compression capacity of the first compressor 2 is larger than the refrigerant compression capacity of the second compressor 4. Accordingly, the first and second compressors 2 and 4 are simultaneously or selectively operated according to the cooling or heating load to be eliminated.

The electronic expansion valve 8 adjusts the opening degree of a passage through which the refrigerant passes, thereby controlling the flow rate of the refrigerant circulating through an air conditioning system. The opening degree of the electronic expansion valve 8 is controlled according to the cooling or heating load.

The outdoor fan 10*a* is installed adjacent to one side of the outdoor heat exchanger 10, and the indoor fan 6*a* is installed adjacent to one side of the indoor heat exchanger 6. Accordingly, the rotating speeds of the outdoor fan 10*a* and the indoor fan 6*a* are changed according to the variation of the cooling or heating load, thereby controlling the amount of blowing of outdoor air and indoor air, respectively.

The control unit (C) of the air conditioner controls the operation of the first and second compressors 2 and 4, the opening degree of the electronic expansion valve 8, and the rotating speeds of the outdoor and indoor fans 6*a* and 10*a*.

Particularly, the air conditioner further comprises a first temperature sensor 22, installed in the refrigerant pipe of the indoor heat exchanger 10, for measuring the temperature of the refrigerant, a second temperature sensor 23, installed in the refrigerant pipe of the outdoor heat exchanger 6, for measuring the temperature of the refrigerant, a third temperature sensor 24, installed at the inlet lines i and i' or the outlet lines o and o' of the first and second compressors 2 and 4, for measuring the temperature of the refrigerant flowing into or out of the first and second compressors 2 and 4, and an outdoor temperature sensor 25, installed adjacent to one side of the outdoor heat exchanger 6, for measuring an outdoor temperature.

When a desired temperature is inputted into the control unit (C) by a user, the control unit (C) sets a target degree of superheat in suction and a target degree of superheat in discharge, and calculates a current degree of superheat in suction and a current degree of superheat in discharge based on the temperatures of the refrigerant measured by the first, second and third temperature sensors 22, 23 and 24. Then, the control unit (C) controls the operations of the first and second compressors 2 and 4, the electronic expansion valve 8, the outdoor fan 6*a*, and the indoor fan 10*a* by the cooling/heating load represented by the target degrees of overheat in suction and exhaust and the current degrees of overheat in suction and exhaust.

Here, the current degree of superheat in suction is determined by the difference between the temperature of the refrigerant at the inlet lines i and i' of the first and second compressors 2 and 4 measured by the third temperature sensor 24 and the temperature of the refrigerant at the evaporator measured by the first or second temperature sensor 22 or 23. The current degree of superheat in discharge is determined by the difference between the temperature of the refrigerant at the outlet lines o and o' of the first and second compressors 2 and 4 measured by the third temperature sensor 24 and the temperature of the refrigerant at the condenser measured by the first or second temperature sensor 22 or 23. The cooling or heating load is represented by the difference between the current degree of superheat in suction and the target degree of superheat in suction and the difference between the current degree of superheat in discharge and the target degree of superheat in discharge.

In order to eliminate the cooling or heating load obtained by the above calculations, the control unit (C) operates the first and/or second compressors 2 and 4. In case that the cooling or heating load to be eliminated is large, the control unit (C) controls the first and second compressors 2 and 4 to be simultaneously operated, the electronic expansion valve 8 to have a large opening degree, and the outdoor and indoor fans 6*a* and 10*a* to be rotated at a high speed. In case that the cooling or heating load to be eliminated is small, the control unit (C) controls the first and second compressors 2 and 4 to be selectively operated, the electronic expansion valve 8 to have a small opening degree, and the outdoor and indoor fans 6*a* and 10*a* to be rotated at a low speed.

Particularly, the control unit (C) controls the opening degree of the electronic expansion valve B in consideration of the simultaneous or selective operations of the first and second compressors 2 and 4 and the outdoor temperature measured by the outdoor temperature sensor 25. A table, which includes minimum and maximum values calculated by the total refrigerant compression capacity of the operating compressors and the outdoor temperature, is stored in the control unit (C) in advance.

Figure 3:
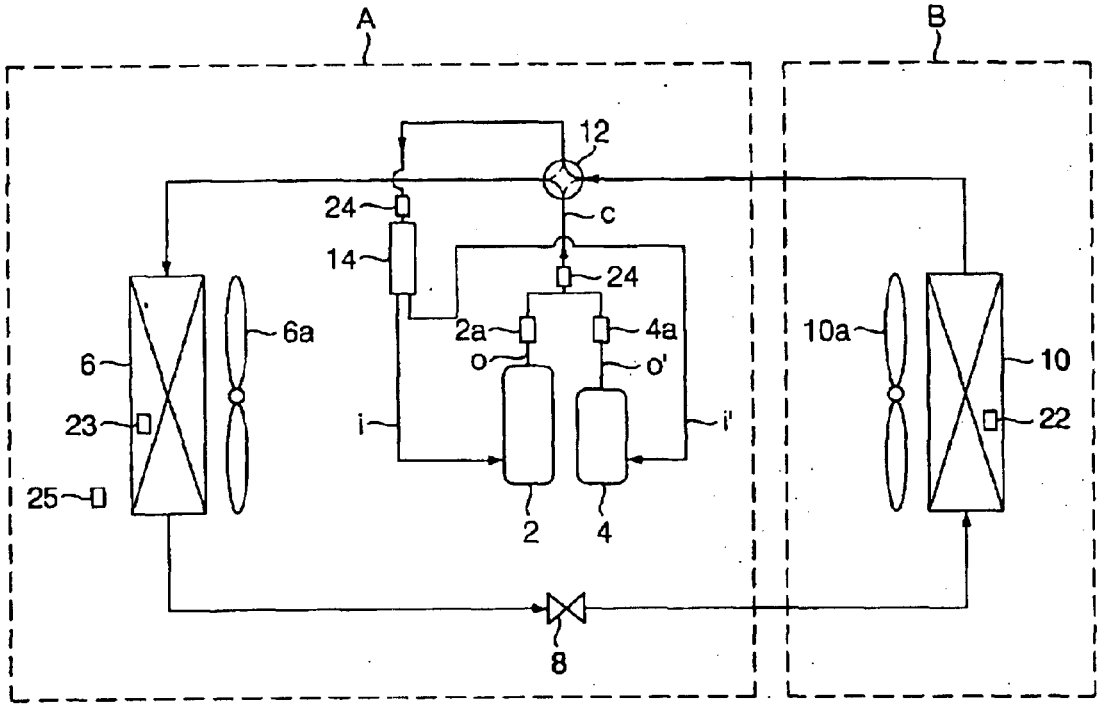
FIG. 3 is a schematic view illustrating the flow of a refrigerant in the air conditioner of the present invention in a cooling mode.
Figure 4:
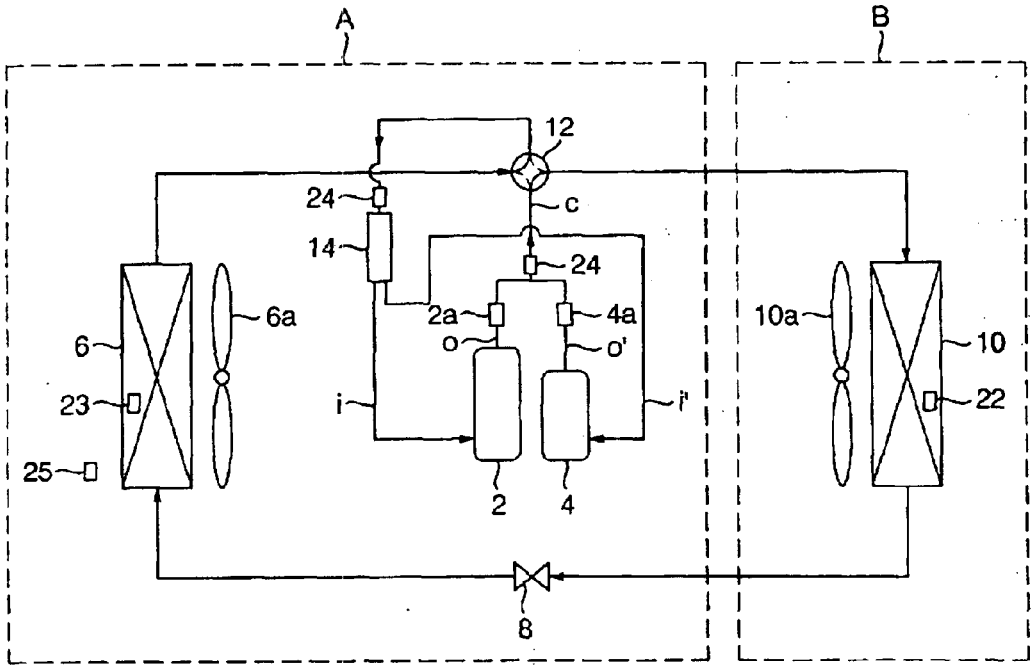
FIG. 4 is a schematic view illustrating the flow of the refrigerant in the air conditioner of the present invention in a heating mode.
Figure 5:
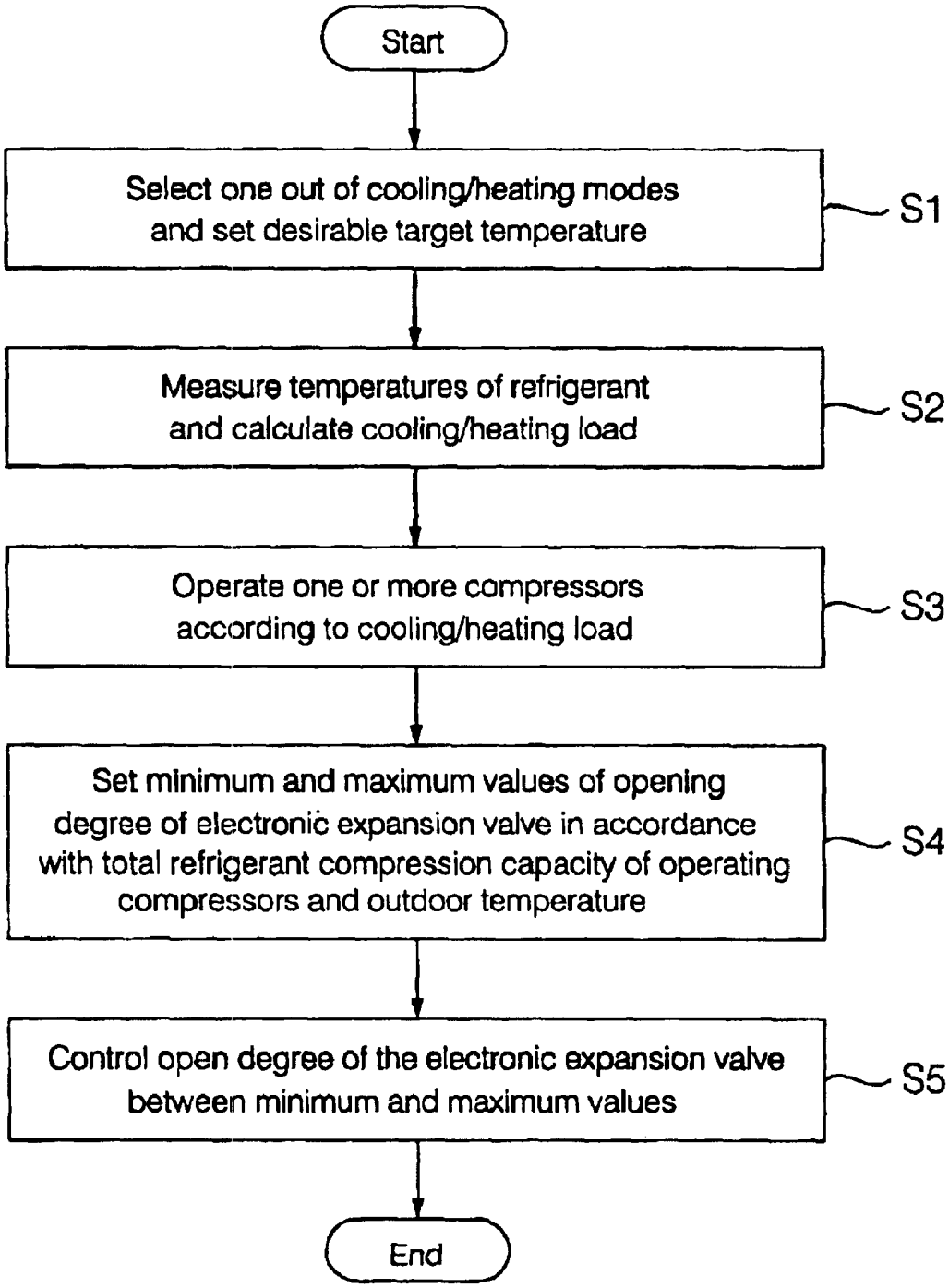
FIG. 5 is a flow chart of a method for controlling the operation of the air conditioner in accordance with the present invention.

Hereinafter, with reference to FIGS. 3 to 5, a method for controlling the operation of the above-described air conditioner will be described in detail.

First, a user selects one of cooling and heating modes, and sets a desirable target temperature (S1).

Here, in case that the cooling mode is selected by the user, the outdoor heat exchanger 6 functions as a condenser and the indoor heat exchanger 10 functions as an evaporator. The direction change valve 12 guides the refrigerant exhausted from the first and second compressors 2 and 4 to the outdoor heat exchanger 6 so that the refrigerant circulates through the first and second compressors 2 and 4, the outdoor heat exchanger 6, the electronic expansion valve 8, and the indoor heat exchanger 10, sequentially.

On the other hand, in case that the heating mode is selected by the user, the outdoor heat exchanger 6 functions as an evaporator and the indoor heat exchanger 10 functions as a condenser. The direction change valve 12 guides the refrigerant exhausted from the first and second compressors 2 and 4 to the indoor heat exchanger 10 so that the refrigerant circulates through the first and second compressors 2 and 4, the indoor heat exchanger 10, the electronic expansion valve 8, and the outdoor heat exchanger 6, sequentially.

Then, after the user sets the desirable target temperature, the control unit (C) sets a target degree of superheat in suction and a target degree of superheat based on the set target temperature.

Second, after the user selects one of the cooling and heating modes and sets the desirable target temperature, the temperatures of the refrigerant are measured and then a cooling/heating load is calculated based on the measured temperatures (S2).

The temperatures of the refrigerant are measured by the first, second and third temperature sensors 22, 23 and 24. More specifically, the temperature of the refrigerant at the indoor heat exchanger 10 is measured by the first temperature sensor 22, and the temperature of the refrigerant at the outdoor heat exchanger 6 is measured by the second temperature sensor 23. The temperature of the refrigerant at the inlet lines i and i' or the outlet lines o and o' of the first and second compressors 2 and 4 is measured by the third temperature sensor 24.

Here, a current degree of superheat in suction and a current degree of superheat in discharge are calculated based on the temperatures of the refrigerant measured by the first, second and third temperature sensors 22, 23 and 24. In the cooling mode, the current degree of superheat in suction is determined by the difference between the temperature of the refrigerant at the inlet lines i and i' of the first and second compressors 2 and 4 and the temperature of the refrigerant at the indoor heat exchanger 10 functioning as the evaporator, and the current degree of superheat in discharge is determined by the difference between the temperature of the refrigerant at the outlet lines o and o' of the first and second compressors 2 and 4 and the temperature of the refrigerant at the outdoor heat exchanger 6 functioning as the condenser. In the heating mode, the current degree of superheat in suction is determined by the difference between the temperature of the refrigerant at the inlet lines i and i' of the first and second compressors 2 and 4 and the temperature of the refrigerant at the outdoor heat exchanger 6 functioning as the evaporator, and the current degree of superheat in discharge is determined by the difference between the temperature of the refrigerant at the outlet lines o and o' of the first and second compressors 2 and 4 and the temperature of the refrigerant at the indoor heat exchanger 10 functioning as the condenser.

The cooling/heating load is determined by the difference between the above current degree of superheat in suction and the target degree of superheat in suction set by the step of S1 and the difference between the above current degree of superheat in discharge and the target degree of superheat in discharge set by the step of S1. Then, in order to eliminate the cooling/heating load, the operation of the air conditioner is controlled.

Third, one or both of the first and second compressors 2 and 4 are operated according to the cooling/heating load determined by the step S2 (S3).

Here, when the air conditioner is operated in an initial stage, the first and second compressors 2 and 4 are simultaneously operated so that the refrigerant circulates through an air conditioning system to rapidly eliminate the cooling or heating load. However, when the cooling or heating load to be eliminated is reduced by the simultaneous operations of the first and second compressors 2 and 4, the cooling or heating load is determined again. Then, the first and second compressors 2 and 4 are simultaneously or selectively operated by the re-determined cooling or heating load.

Fourth, a minimum value and a maximum value of an opening degree of the electronic expansion valve 8 are set by the refrigerant compression capacities of the compressors operated in the step S3 and the outdoor temperature (S4).

Here, the control unit (C) obtains the minimum and maximum values of the opening degree of the electronic expansion valve 8 from a table, which includes minimum and maximum values calculated by the total refrigerant compression capacity of the operating compressor(s) 2 and/or 4 and the outdoor temperature measured by the outdoor temperature sensor 25.

In the cooling mode, in case that the first and second compressors 2 and 4 are simultaneously operated, when a current outdoor temperature is more than the set value, the minimum and maximum values are set so that a passage through the electronic expansion valve 8 is opened in the range of 46~64%. When the current outdoor temperature is not more than the set value, the minimum and maximum values are set so that the passage through the electronic expansion valve 8 is opened in the range of 32~64%.

When the current outdoor temperature is more than the set value, in order to prevent the first and second compressors 2 and 4 from overheating due to the increase of the cooling load, the minimum value is set to have a larger value so that the circulating rate of the refrigerant cannot be reduced not more than a constant level.

Further, in the cooling mode, in case that only the second compressor 4 is operated, the minimum and maximum values are set so that the passage through the electronic expansion valve 8 is opened in the range of 18~38%.

On the other hand, in the heating mode, in case that the first and second compressors 2 and 4 are simultaneously operated, the minimum and maximum values are set so that the passage through the electronic expansion valve 8 is opened in the range of 16~50%.

Further, in the heating mode, in case that only the first compressor 2 is operated, the minimum and maximum values are set so that the passage through the electronic expansion valve 8 is opened in the range of 16~50%.

Table 1 shows the minimum and maximum values of the electronic expansion valve of the air conditioner in which the first compressor has a refrigerant compression capacity of 60% of the total capacity of the air conditioner, the second compressor has a refrigerant compression capacity of 40% of the total capacity of the air conditioner, and the electronic expansion valve has an opening degree controlled in the range of 0~500 pulse.

TABLE 1

| | Refrigerant Compression capacity | Minimum value | Maximum opening Degree |
|---|---|---|---|
| Cooling mode | 100% | 230 pulse (Outdoor temp. ≧ 40° C.) 160 pulse (Outdoor temp. < 40° C.) | 320 pulse |
| | 40% | 90 pulse | 190 pulse |
| Heating mode | 100% | 80 pulse | 250 pulse |
| | 60% | 60 pulse | 220 pulse |

That is, it is noted that the minimum and maximum values are variably changed in accordance with the operation mode of the air conditioner and the total capacity of the operating compressors. The minimum and maximum values in the heating mode are lower than those in the cooling mode. Further, the minimum and maximum values when only one of two compressors is operated are lower than those when both of two compressors are simultaneously operated.

Fifth, the opening degree of the electronic expansion valve 8 is controlled within the range between the minimum value and maximum value, which are set in the step S4 (S5).

More specifically, when the opening degree of the electronic expansion valve 8 is lower than the minimum value, the circulating rate of the refrigerant is smaller than the rate of the refrigerant compressed by the operating compressors, i.e., the total refrigerant compression capacity of the operating compressors, thus causing the operating compressors to overheat. On the other hand, when the opening degree of the electronic expansion valve 8 is higher than the maximum value, the circulating rate of the refrigerant is larger than the rate of the refrigerant compressed by the operating compressors, thus causing the refrigerant to be introduced into the operating compressors. Accordingly, the opening degree of the electronic expansion valve 8 is controlled within the range between the set minimum and maximum values.

As described above, the control unit (C) controls the operations of the first and second compressors in accordance with the cooling or heating load to be eliminated, thereby variably changing the total refrigerant compression capacity of the air conditioner. Further, the control unit (C) controls the opening degree of the electronic expansion valve 8, thereby variably changing the circulating rate of the refrigerant. Accordingly, it is possible to rapidly eliminate the cooling or heating load and to stably operate an air conditioning system using the above air conditioner.

The apparatus and the method for controlling the operation of the air conditioner in accordance with the present invention have several advantages, as follows.

First, one or more compressors are operated according to a cooling or heating load in a cooling or heating mode so that the total refrigerant compression capacity of the operating compressors can be variably changed, and an opening degree of an electronic expansion valve is controlled within a range set in accordance with the total refrigerant compression capacity so that the circulating rate of the refrigerant can be variably changed, thereby allowing the air conditioner to rapidly eliminate the cooling or heating load and to improve the efficiency of the air conditioner.

Second, minimum and maximum values are calculated by the total refrigerant compression capacity of the operating compressors and an outdoor temperature, and the opening degree of the electronic expansion valve is controlled between the minimum and maximum values, thereby preventing the operating compressors from overheating in case that the circulating rate of the refrigerant is smaller than the rate of the refrigerant compressed by the operating compressors, and preventing the refrigerant in a liquid state from being introduced into the operating compressors in case that the circulating rate of the refrigerant is larger than the rate of the refrigerant compressed by the compressors. Accordingly, it is possible to prevent the failure of the air conditioner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling an operation of an air conditioner having a plurality of compressors simultaneously or selectively operated according to a cooling/heating load for compressing a refrigerant so that the total refrigerant compression capacity of the operating compressors are variably changed, a condenser for condensing the refrigerant compressed by the compressors by heat-exchanging the refrigerant with air, an electronic expansion valve for expanding the refrigerant condensed by the condenser by decompressing the refrigerant, an evaporator for evaporating the refrigerant expanded by the electronic expansion valve by heat-exchanging the refrigerant with air, and a refrigerant pipe for connecting the compressors, the condenser, the electronic expansion valve, and the evaporator, comprising:

a first temperature sensor, installed at the refrigerant pipe connected to the condenser, for measuring the temperature of the refrigerant;

a second temperature sensor, installed at the refrigerant pipe connected to the evaporator, for measuring the temperature of the refrigerant;

a third temperature sensor, installed at the refrigerant pipe connected to the compressors, for measuring the temperature of the refrigerant sucked into or discharged from the compressors; and a control unit for calculating the cooling/heating load according to the temperatures of the refrigerant measured by the first, second and third temperature sensors and a desirable target temperature set by a user, controlling the operation of the plural compressors according to the cooling/heating load, calculating minimum and maximum values of an opening degree of the electronic expansion valve according to the total refrigerant compression capacity of operating compressors selected from the plural compressors, and controlling the opening degree of the electronic expansion valve between the minimum and maximum values.

2. The apparatus as set forth in claim 1, wherein the plural compressors include first and second compressors having different refrigerant compression capacities.

3. The apparatus as set forth in claim 2, wherein the refrigerant compression capacity of the first compressor is larger than that of the second compressor.

4. The apparatus as set forth in claim 3, wherein the control unit operates both of the first and second compressors simultaneously, or operates only the second compressor, according to the cooling load, in a cooling mode.

5. The apparatus as set forth in claim 3, wherein the control unit operates both of the first and second compressors simultaneously, or operates only the first compressor, according to the heating load, in a heating mode.

6. The apparatus as set forth in claim 3, further comprising an outdoor temperature sensor installed at one side of an outdoor heat exchanger functioning as the condenser or the evaporator.

7. The apparatus as set forth in claim 6, wherein the control unit calculates the minimum and maximum values of the electronic expansion valve in consideration of the outdoor temperature measured by the outdoor temperature sensor.

8. A method for controlling an operation of an air conditioner comprising the steps of:

(a) operating one or more of a plurality of compressors so that the total refrigerant compression capacity of the operating compressors is variably changed according to a cooling/heating load;

(b) setting minimum and maximum values of an opening degree of an electronic expansion valve according to the total refrigerant compression capacity of the operating compressors in a cooling or heating mode; and (c) controlling an opening degree of the electronic expansion valve between the set minimum and maximum values.

9. The method as set forth in claim 8, wherein the step (a) includes the step of determining whether first and second compressors having different refrigerant compression capacities are simultaneously or selectively operated.

10. The method as set forth in claim 9, wherein the refrigerant compression capacity of the first compressor is larger than that of the second compressor.

11. The method as set forth in claim 10, wherein the first and second compressors are simultaneously operated, or only the second compressor is operated, according to the cooling load, at the step (a) in a cooling mode.

12. The method as set forth in claim 10, wherein the first and second compressors are simultaneously operated, or only the first compressor is operated, according to the heating load, at the step (a) in a heating mode.

13. The method as set forth in claim 11, wherein the step (b) includes the step of variably setting the minimum and maximum values of the electronic expansion valve in accordance with the outdoor temperature, in case that both of the first and the second compressors are simultaneously operated in the cooling mode.

14. The method as set forth in claim 13, wherein the minimum and maximum values are set so that a passage through the electronic expansion valve is opened in the range of 46~64% at the step (b), when the outdoor temperature is more than a set value, in case that both of the first and the second compressors are simultaneously operated in the cooling mode.

15. The method as set forth in claim 13, wherein the minimum and maximum values are set so that a passage through the electronic expansion valve is opened in the range of 32~64% at the step (b), when the outdoor temperature is not more than a set value, in case that both of the first and the second compressors are simultaneously operated in the cooling mode.

16. The method as set forth in claim 11, wherein the minimum and maximum values are set so that a passage through the electronic expansion valve is opened in the range of 18~38% at the step (b), in case that only the second compressor is operated in the cooling mode.

17. The method as set forth in claim 12, wherein the minimum and maximum values are set so that a passage through the electronic expansion valve is opened in the range of 16~50% at the step (b), in case that both of the first and the second compressors are simultaneously operated in the heating mode.

18. The method as set forth in claim 12, wherein the minimum and maximum values are set so that a passage through the electronic expansion valve is opened in the range of 12~44% at the step (b), in case that only the first compressor is operated in the heating mode.

* * * * *